US006451427B1

(12) United States Patent
Takashima

(10) Patent No.: US 6,451,427 B1
(45) Date of Patent: Sep. 17, 2002

(54) SINGLE FIBER CONTAINING CARBON POWDER INSIDE THE FIBER, PROCESSED WORK AND COTTON WORK THEREOF, PROCESSED WORK AND COTTON WORK CONTAINING CARBON POWDER ON THE FIBER SURFACE OR IN THE FIBERS, AND PRODUCING THEREOF

(76) Inventor: Hisato Takashima, 5-18, Kasuga-cho, Takatsuki-shi, Osaka-fu, 569-0053 (JP)

( * ) Notice: Subject to any disclaimer, the term of this patent is extended or adjusted under 35 U.S.C. 154(b) by 0 days.

(21) Appl. No.: 09/920,516

(22) Filed: Jul. 31, 2001

(30) Foreign Application Priority Data

Aug. 1, 2000 (JP) ..... 2000-233149

(51) Int. Cl.[7] ..... D01F 6/00
(52) U.S. Cl. ..... 428/372
(58) Field of Search ..... 428/372, 394, 428/368, 395

(56) References Cited

U.S. PATENT DOCUMENTS 4,559,164 A * 12/1985 Kostelnik et al. ..... 252/511
4,610,925 A * 9/1986 Bond ..... 428/368
5,206,085 A * 4/1993 Nakagawa et al. ..... 428/372
5,928,785 A * 7/1999 Nishida et al. ..... 428/372

* cited by examiner

*Primary Examiner*—N Edwards
(74) *Attorney, Agent, or Firm*—Curtis L. Harrington

(57) ABSTRACT

This invention relates to the single fiber having superior deodorization and hygroscopicity since carbon powder is contained inside thereof, the processed work and the cotton work thereof, and the producing wherein there is no blocking on an injection nozzle and a disagreeable smell does not occur when carbon powder is contained to the processed work and the cotton work, and whereof the single fiber wherein it is comprised by melting and spinning out of synthetic resin pellet compounding 1-30 weight % of fine carbon powder having 20 $\mu$m or less as pigment, the processed work and the cotton work wherein carbon powder is contained on the fiber surface and/or inside of the fibers, the producing of the processed work, wherein diluted solution of emulsion comprises at least carbon powder, surfactant and water is sprayed or immersed to the processed work and the work is dried with heating.

42 Claims, 1 Drawing Sheet

SINGLE FIBER CONTAINING CARBON POWDER INSIDE THE FIBER, PROCESSED WORK AND COTTON WORK THEREOF, PROCESSED WORK AND COTTON WORK CONTAINING CARBON POWDER ON THE FIBER SURFACE OR IN THE FIBERS, AND PRODUCING THEREOF

FIELD OF THE INVENTION

This invention relates to the single fiber containing carbon powder inside the fiber, the processed work and the cotton work thereof, the processed work and the cotton work containing carbon powder on the fiber surface or in the fibers, and producing thereof. Its work is to provide the single fiber having superior deodorization and hygroscopicity and the processed work and the cotton work thereof; in addition, to provide the producing wherein there is no blocking on an 3injection nozzle and disagreeable smell and so on does not occur when carbon powder is contained to the processed work and the cotton work.

Incidentally, in the present invention, the cotton work means cotton after the single fiber spun is cotton-opened spun, cushion material, nonwoven fabric and so on. Further, the processed work in this invention means textile or knitting goods processed from weaving yarn twisted or knitting yarn.

PRIOR ART

Accompanying with progress of technology, the new material is born one after another, and the material of the goods needed for our daily life has been changed considerably with a decade ago. While the new material has new function and/or it gives easiness of use and convenience, it may cause unexpected situation. For example, a series of condition called Sick-house syndrome is given as the problem in recent years, and it is considered that detrimental organic compounds, such as formaldehyde contained in the glue used for wallpaper etc. in general home are one of causes.

Then, in order to eliminate such a detrimental substance in general home and to eliminate smell of a pet, tobacco and so on, deodorization function into the material comprising wallpaper, curtain and so on is given. Moreover, giving the deodorization function is done into the other materials, for example, such function is given into the fiber comprising clothes and bedclothes.

As an art giving the deodorization function into fiber, for example, the cotton, fiber and wallpaper added charcoal and for producing thereof are disclosed in Japan patent publication Tokukaihei 11-229219. This art is what solvent blended acrylic resin and charcoal is sprayed or immersed to cotton or a fiber so that deodorization function is given with adding charcoal into cotton, a fiber or so on.

However, the following problems existed in the art indicated in Japan patent publication Tokukaihei 11-229219.

First, it is what solvent blended acrylic resin and charcoal is sprayed or immersed to cotton or a fiber so that charcoal is adhered to cotton or a fiber, but since acrylic resin is used as a binder, there is the problem that an injection nozzle is blocked so that it is difficult to manufacture preferably when it is manufactured continuously for a long time. Moreover, either method of the case in splaying or the case in immersing, viscosity of solvent increases because of the acrylic resin as a binder so that it is possible to adhere charcoal near the surface of cotton or a fiber, but there is a problem that it is hard to adhere charcoal inside of cotton or a fiber. Incidentally, a disagreeable smell was emanated during the manufacture since resin is used, and the safety of the manufactured product was not enough.

DETAILED DESCRIPTION OF THE INVENTION

Figure 1:
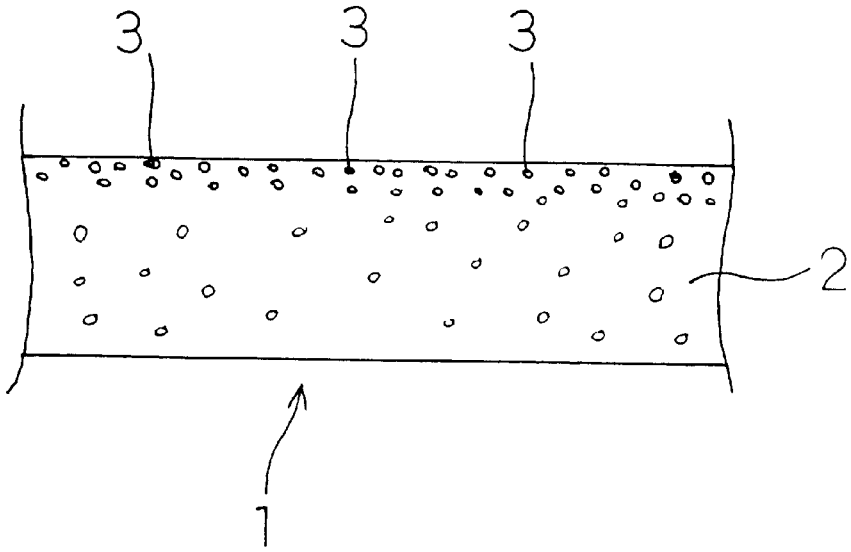
FIG. 1 is a model sectional view of the processed work containing carbon, related to the present invention.

First, the single fiber containing carbon powder inside of the fiber, related to the present invention will be described.

The single fiber containing carbon powder inside of the fiber, related to the present invention contains carbon powder beforehand inside of the fiber.

As a fiber used in the single fiber containing carbon powder inside of the fiber, related to the present invention, it is mainly chemical fiber, and all chemical fibers, such as recycled fiber, half-synthetic fiber, synthetic fiber, and inorganic fiber, can be used as chemical fiber. Concretely, as recycled fiber, cellulose recycled fiber, such as rayon and cuprammonium, recycled silk thread, milk protein fiber, soybean protein fiber, corn protein fiber, protein recycled fiber, such as peanut protein fiber, and other alginic acid fibers, natural rubber, etc. can be exemplified. As half-synthetic fiber, acetate, a promix, chloride rubber, hydrochloric acid rubber, etc. can be exemplified. As synthetic fiber, polyamide fiber, polyester fiber, polyacrylics nitril fiber, polyvinyl alcohol fiber, polypropylene fiber, polyvinyl chloride fiber, polyethylene fiber, polyethylene terephthalate fiber, polyvinylidene chloride fiber, polyurethane fiber, polyalkylene paraoxibenzoate fiber, polychlal fiber, fluoric fiber, estamid fiber, polyfluoro ethylene fiber, polyvinylidene cyanide fiber, polyurea fiber, etc. can be exemplified. Further, as an inorganic fiber, a glass fiber, a metal fiber, etc. can be exemplified. Moreover, optional additives, such as antibacterial agent, a bacteriostat, a catalyst, a coloring prevention agent, a heat-resistant agent, a flame retardant, an oxidization prevention agent and an inorganic subtlety particle may be added by the above described fiber if necessary.

Incidentally, in this invention, synthetic fiber in these chemical fibers is used preferably, and polyester fiber, polyacrylics nitril fiber, polypropylene fiber, polyvinyl chloride fiber, polyethylene fiber, polyethylene terephthalate fiber, and polyvinylidene chloride fiber in particular are used more preferably.

More particularly preferably, using the recycled polyethylene terephthalate resin regenerated from used good made of polyethylene terephthalate is preferable. Since synthetic resin pellet: recycled article becomes to blacken even if carbon powder is not contained, 1.0 $\mu$m or less, more preferably 0.01–1.0 $\mu$m of fine carbon powder 6–15 weight % is contained, transparent single fiber is prepared from pure synthetic resin pellet, and tone of collar can be adjusted by those content. If the content of the carbon powder is less than 6 weight %, no effect by carbon powder because of blending can be obtained; and if over 15 weight % is compounded, single fiber intensity will be weak; therefore, neither case is preferable. Moreover, this is because that if particle diameter is over 1.0 μm, it will be hard to add into single fiber made of recycled polyethylene terephthalate resin. Incidentally, the process comprising steps of: heating synthetic resin single fiber; opening such single fiber partially; and blending carbon powder therein, or the process wherein carbon powder is adhered to the surface in the spinning process of single fiber can be adapted.

For the carbon powder used in the present invention, either of white carbon obtained by that material wood is burned at 750–1200° C. and is carbonized at 350–520° C. or black carbon obtained by that material wood is burned at 400–750° C. and is carbonized at 250–450° C. can be used preferably, furthermore carbon black made from petroleum can be used. For example, as white carbon, charcoal that material wood is oak kind or Japanese oak kind belonging to the beech family (Fagaceae), Japanese oak genus (Quercus), such as Bintyo charcoal that material wood is Ubamegashi (*Quercus phillyraeoides*) burned around 1200° C. or charcoal that material wood is conifer, such as Japan cedar (*Cryptomeria japonica*), Japanese cypress (*Chamaecyparis obtusa*), Japanese red pine (*Pinus densiflora*), Japanese black pine (*Pinus thunbergii*), can be exemplified. Moreover, as black carbon, charcoal that material wood is Kunugi (*Quercus acutissima*), Konara (*Quercus serrta Thunb*), etc. can be exemplified. Furthermore, charcoal using the bamboos belonging to the rice plant family (Gramineae) or activated carbon can be used preferably. In the present invention, charcoal or charcoal of bamboo is used preferably in particular, Bintyo charcoal is used more preferably.

Although the particle diameter of the carbon powder used is not limited in particular, 0.1–20 μm is preferable for example, preferably 0.5–10 μm, more preferably 0.5–5 μm. If it is less than 0.1μm, the number of processes for pulverization will increase, and if it is over 20 μm, the intensity of fiber may fall; therefore neither of the cases is preferable. However, carbon powder having 0.1 μm or less is prepared and then may be contained if needed.

Incidentally, when carbon black is used as carbon powder, the particle diameter of the carbon black is not limited especially, but it should be 0.01–1 μm. This is because that it is difficult to prepare less than 0.01 μm of the particle diameter, and it is also difficult to prepare over 1 μm of the particle diameter.

Further, in the present invention, it is possible to use two kinds or more of the carbon powder described above. Using both charcoal or charcoal of bamboo, such as Bintyo charcoal, and carbon black is preferable in particular. This is because that charcoal and/or bamboo charcoal is superior in hygroscopicity and deodorization, but it is difficult to color substantially uniformly since the particle diameter is relatively large. Making the particle diameter small is desirable, but in this case, said effect will decrease. Thus, by blending fine particle diameter of carbon black, it will be superior in hygroscopicity and deodorization and it will be possible to color substantially uniformly. When both charcoal and/or charcoal of bamboo and carbon black are used, the compounding ratio is not limited especially, but charcoal and/or charcoal of bamboo and carbon black=1:0.5–4, preferably 1:1–3, more preferably 1:1.5–2.5, in weight ratio.

If the compound amount of carbon black is less than 0.5 weight times of the compound amount of charcoal and/or charcoal of bamboo, no effect because of compounding carbon black can be obtained; and if the compound amount of carbon black is over 4 weight times of the compound amount of charcoal and/or charcoal of bamboo, hygroscopicity and deodorization will be inferior; therefore neither case is preferable.

In order to contain the charcoal powder and/or carbon black into single fiber beforehand, the necessary quantity of carbon powder is compounded with the synthetic resin being the materials as described above, a pellet is made, and this is span into single fiber. Incidentally, the method of spinning may be any of melt spinning, dry spinning, wet spinning, and emulsion spinning, and the method suitable for the synthetic resin used should be adopted.

The compound amount of carbon powder will be 1–50 weight % to the synthetic resin used. If the compound amount of carbon powder is less than 1 weight %, the effect by compounding carbon powder is not acquired, and if over 50 weight % is compounded, the intensity of the fiber may fall; therefore neither of the cases is preferable. Particularly preferably, 6–15 weight % thereof is compounded. Incidentally, when pellet is spun and single fiber is made, carbon powder may be compounded. In this case, the compound amount of carbon powder is not limited especially, but it will be 7–20 weight %.

Moreover, although the thickness of the single fiber to be spun is not limited, it will be 5–20 deniers and 10–15 deniers will be preferable.

Thus, by containing carbon powder inside the fiber beforehand, the single fiber containing the carbon powder inside the fiber, related to the present invention can be obtained. Furthermore, such single fiber can be processed to any optional form. For example, after twisting such single fiber and making knitting yarn or weaving yarn, a processed work can be obtained by making knitting goods or textiles. Moreover, after such single fiber is cotton-opened, optional cotton work, such as cotton, nonwoven fabric, and cushion material, can be obtained. Incidentally, when making the processed work or the cotton work, it can be formed just from single fiber compounded carbon powder, or fibers not compounded carbon powder, for example natural fibers whereof: vegetable fibers such as cotton, kapok and hemp; animal fibers such as silk, wool and goat hair: for instance, Angora wool goat hair, cashmere and so on, can be compounded properly in addition to chemical fibers described above.

The single fiber manufactured as above, and the processed work and cotton work manufactured from such single fiber have superior deodorization and hygroscopicity without falling carbon powder since carbon powder is contained beforehand inside the fiber. Furthermore, there is no restriction in the use, and flexibility is high.

Next, the concrete producing of the single fiber containing the carbon powder inside the fiber and cotton work comprised of such single fiber, related to the present invention will be described with exemplifying the case that nonwoven fabric is processed with using recycled polyethylene terephthalate fiber as fiber.

First, recycled synthetic resin which is for material of fiber, in this case: recycled pellet obtained by blending particle diameter 1–0.1 μm of the ratio 1:2 for charcoal powder and carbon black and by adding necessary quantity; for example, 5 weight % thereof into polyethylene terephthalate, is melted. By spinning this and making to the necessary thickness, 10 deniers for example, the single fiber which containing carbon powder inside PET fiber can be manufactured.

Next, after said manufactured single fiber is cotton-opened, necessary quantity is measured, and then it is formed to sheet-shape and is layered until it becomes necessary thickness so that the web is made. Finally the web is pierced with needle punch, the single fiber in the web is pushed in, and it is intertwined so that a nonwoven fabric can be manufactured. Incidentally, the method of manufacturing a nonwoven fabric is not limited particularly, but can be manufactured by well-known methods, such as a method of gluing fibers using glue or a stitching method, a spray fiber method, and a spun-bond method besides said needle punch method.

Figure 2:
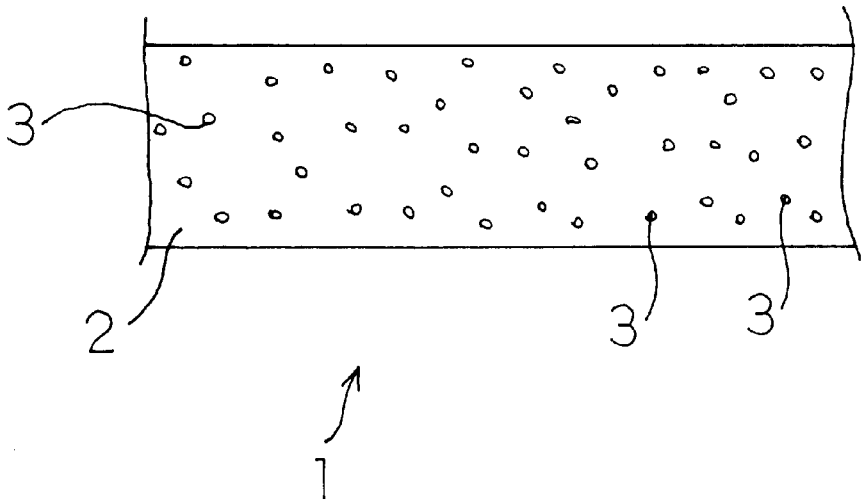
FIG. 2 is a model sectional view of the processed work containing carbon, related to the present invention.

Next, the processed work and the cotton work containing the carbon powder on the fiber surface or in the fibers, related to the present invention will be explained with reference to drawing. FIG. 1 and FIG. 2 are model sectional views of the processed work containing carbon powder on the fiber surface or in the fibers, related to the present invention.

The processed work and cotton work containing carbon powder on the fiber surface or in the fibers, related to the present invention (hereinafter, just called the processed work containing carbon and the cotton work containing carbon) have a characteristics whereof carbon powder (3) is contained in the fibers: with concentrating on the surface of the processed work (2) as the processed work containing carbon (1) shown in FIG. 1; or with dispersing on the surface and the inside of the processed work (2) as the processed work containing carbon (1) shown in FIG. 2.

The processed work (2) used in the processed work containing carbon (1) is the textiles or knitting goods manufactured from at least one or more kinds of yarn manufactured by spinning, manufacturing yarn, spinning yarn, twisting yarn of one kind or two kinds or more of fibers described later. Further, the cotton work used in the cotton work containing carbon, related to the present invention is cotton obtained by cotton-opening of the single fiber, cushion material, a nonwoven fabric or so on manufactured by spinning of one kind or two kinds or more of fibers described later.

Moreover, as the processed work (2) used in the processed work containing carbon (1), the processed work comprising the single fiber containing carbon powder inside the fiber, as described the above, can be used, and as the cotton work used in the cotton work containing carbon, the cotton work comprising the single fiber containing carbon powder inside the fiber, as described the above, can be used In addition to the chemical fibers described above, natural fiber can be used as the fiber comprising the processed work containing carbon (1) and the cotton work containing carbon. As natural fiber: vegetable fibers such as cotton, kapok and hemp; and animal fibers such as silk, wool and goat hair: for instance and Angora wool goat hair, cashmere and so on, can be exemplified. Optional additives, such as antibacterial agent, a bacteriostat, a catalyst, a coloring prevention agent, a heat-resistant agent, a flame retardant, an oxidization prevention agent and an inorganic subtlety particle may be compounded to said fiber if necessary.

As the carbon powder (3) used in the processed work containing carbon (1) and the cotton work containing carbon, the same kind of carbon powder as the carbon powder described above can be used. Further, the particle diameter of the carbon powder (3) used in the processed work containing carbon (1) and cotton work, related to the present invention is not limited, but 0.1-500 μm is preferable and 0.5-50 μm is more preferable. This is because that if it is less than 0.1 μm, the number of processes for pulverization will increase, and if it is over 500 μm of the partial diameter, it may fall from processing work (2) and cotton work; therefore, neither of the cases is preferable.

Incidentally, when carbon black is used as carbon powder, the particle diameter is not limited especially, but it will be 0.01-1 μm. This is because it is difficult prepare less than 0.01 μm of particle diameter, and it is also difficult prepare over 1 μm of particle diameter.

Further, in the present invention, it is possible to use two kinds or more of the carbon powder described above. Using both charcoal or charcoal of bamboo, such as Bintyo charcoal, and carbon black is preferable in particular. This is because that charcoal and/or bamboo charcoal is superior in hygroscopicity and deodorization, but it is difficult to color substantially uniformly since the particle diameter is relatively large. Making the particle diameter small is desirable, but in this case, said effect will decrease. Thus, by blending fine particle diameter of carbon black, it will be superior in hygroscopicity and deodorization and it will be possible to color substantially uniformly. When both charcoal and/or charcoal of bamboo and carbon black are used, the compounding ratio is not limited especially, but charcoal and/or charcoal of bamboo and carbon black=1:0.5-4, preferably 1:1-3, more preferably 1:1.5-2.5, in weight ratio.

If the compound amount of carbon black is less than 0.5 weight times of the compound amount of charcoal and/or charcoal of bamboo, no effect because of compounding carbon black can be obtained; and if the compound amount of carbon black is over 4 weight times of the compound amount of charcoal and/or charcoal of bamboo, hygroscopicity and deodorization will be inferior; therefore neither case is preferable.

Moreover, the content of carbon powder (3) will be adjusted properly so as the total amount of carbon powder in the processed work containing carbon (1) and the cotton work containing carbon is 1-20 weight %

In order to make the processed work containing carbon (1) and the cotton work containing carbon, related to the present invention by containing said carbon powder (3) to processed work (2) and cotton work, the diluted solution of emulsion prepared from carbon powder (3) and water using the surfactant is sprayed or immersed to the above-described processed work (2) and cotton work.

As surfactant used when preparing the diluted solution of emulsion, any surfactant which can disperse like said carbon powder (3) into water can be used. For example, such as alkylsulfate, alkylphosphate, polycarboxylate, fatty acid salt, alkylbenzylsulphonate, alkylsulfosuccinate, alkyldiphenyletherdisulphonate, polyoxiethylene alkylsulfate, allylalkylsulfate, polyoxiethylene alkylphosphate, naphthalene sulfonic acid and formalin condensate can be exemplified.

Incidentally, water-soluble high polymers, such as hydroxyethylcellulose, as the form stabilizer, sodium metaphosphate and the like as dispersion adjuvant, and additives such as antiseptic and colorant besides surfactant and carbon powder which are indispensable components may be compounded properly and optionally.

To prepare the diluted solution of emulsion from each component explained as above, it can be prepared by blending necessary amount of each component to water. Incidentally, if dispersion of carbon powder is inferior with this method, all additives such as carbon powder and surfactant are blended to a little amount of water and are made to paste-shape beforehand, and then may be diluted with remained water.

Moreover, content of surfactant is not limited especially, but it is added to become 0.01-5 part by weight, more preferably 0.1-3 part by weight, when the total amount of compounded components is set to 100 part by weight. This is because that: if content of surfactant is less than 0.01 part by weight, carbon powder can not be dispersed in water; and if more than 5 part by weight is compounded, no further effect can be expected; therefore, neither case is preferable.

Incidentally, content of water and carbon powder is not limited especially, but it may adjusted to become 1:0.1-10 in weight ratio, preferably 1:0.2-5, more preferably 1:0.5-2. This is because both in the case that the compound amount of carbon powder is less than 0.1 weight times of the compound amount of water and in the case that the compound amount of carbon powder is over 5 weight times of the compound amount of water, dispersion of carbon powder can not be improved.

After diluted solution of emulsion prepared from each composition as explained above is sprayed to the processed work (2) or the cotton work, or after diluted solution of emulsion is immersed to the processed work (2) or the cotton work, and by being dried, the processed work containing carbon powder (1) or the cotton work, related to the present invention can be obtained.

Incidentally, drying after emulsion is applied is carried out with heated drying. Heating temperature is not limited especially, but it is at 100-200° C., preferably at 120-170° C. This is because that if it is less than 100° C., it is impossible to dry sufficiently; and if heating is at more than 200° C., no further effect can be obtained.

Next, concrete producing for the processed work and the cotton work containing carbon powder, related to the present invention will be explained with exemplifying the case used cotton, as cotton work, comprised of polyester fibers.

First, after polyester fiber is cotton-opened, necessary amount is measured. Next, it is loaded and formed to sheet-shape, and then it is layered until it becomes necessary thickness and is made to web. The web is pierced with a needle punch, fiber in the web is pushed in, and it is intertwined so that cotton is manufactured.

Next, diluted solution of emulsion prepared separately is injected to such cotton thoroughly. Further, diluted solution of emulsion may be immersed. Finally, by heated drying under the temperature condition of approximately 150° C., the cotton work containing carbon powder, related to the present invention can be obtained.

Since the processed work and the cotton work containing carbon powder, related to the present invention contain carbon powder on the fiber surface and/or inside fibers, they have superior deodorization and hygroscopicity. Further, since carbon powder is applied as diluted solution of emulsion to the processed work and the cotton work, there is no fear of getting an injection nozzle blocked when injecting; in addition, since it penetrates inside of the processed work and the cotton work, carbon powder can be dispersed not only near the surface of the processed work and the cotton work but an inside thereof.

EXAMPLE

The present invention will be described in detail with showing examples hereinafter. However, this invention is not limited by the following examples at all.

Preparation of Samples on Examples 1 and 2

First, 8 weight % of carbon powder, which is blended with particle diameter 0.1-1.0 $\mu$m of carbon black powder and carbon powder at ratio 1:2, was blended to the powder of used PET, which is the material of recycled PET fiber so that pellet was made, and then such pellet was melted with heating. Then it was spun so that thickness approximately 15 deniers of PET fiber containing carbon powder inside the fiber was made as sample of Example 1.

Next, after said manufactured sample of the Example 1 was cotton-opened, it was formed to sheet-shape and was layered until it becomes necessary thickness so that it was made to web. Finally, the web was pierced with a needle punch, fiber in the web was pushed in, and it was intertwined so that manufactured cotton was made as sample of Example 2

Preparation of Sample on Example 3

First, polyester was cotton-opened, it was formed to sheet-shape and was layered until it becomes necessary thickness so that it was made to web. Then, the web was pierced with a needle punch, fiber in the web was pushed in, and it was intertwined so that cotton work was manufactured.

Next, emulsion prepared separately so as the ratio of surfactant: water: carbon powder is 6:5:1, was injected thoroughly to said manufactured cotton work. Finally, it was heated drying under the temperature condition of approximately 150° C., and the cotton work containing carbon powder was made as sample of Example 3

Said prepared sample of the Example 1 contained carbon powder inside the fiber. Furthermore, the intensity of such fiber was not inferiority as compared with the fiber not compounded carbon powder. Moreover, in usual use situation on the samples of Examples 2 and 3, carbon powder was not fallen.

Test; Deodorization Test

The deodorization test was carried out using said prepared sample of Example 3. The test method is as follows: 10×20 cm of the sample of the Example 3 was put in 5 liters of a tetra bag (the amount of gas in a container is 3 liters), which was prepared so as the concentration of ammonia is set to 400 ppm, and the concentration of ammonia in the container after required time was passed under temperature condition of 20° C. was measured using the Kitagawa-type detection pipe. Moreover, the case using formaldehyde with preparing so as initial concentration is set to 15.0 ppm was also measured as the same method. Incidentally, as comparative example, change of the ammonia concentration and formaldehyde concentration with putting in no sample of the examples was also measured under the same condition. A result is shown in Table 1.

TABLE 1

| | Sample | 0 min. | 10 min. | 20 min. | 30 min. | 60 min. | 90 min. | 120 min. |
|---|---|---|---|---|---|---|---|---|
| Ammonia (ppm) | Example | 400 | 115 | 110 | 105 | 99.0 | 86.0 | 86.0 |
| | Comparative example | 400 | 400 | 400 | 400 | 400 | 400 | 400 |
| Formaldehyde (ppm) | Example | 15.0 | — | — | 2.6 | — | — | 0.4 |
| | Comparative example | 15.0 | — | — | 15.0 | — | — | 15.0 |

As the result of Table 1, it is found that the processed work containing carbon has superior deodorization to toxic substances, such as ammonia and formaldehyde.

Effect of the Invention

As described above, since the single fiber containing carbon powder inside the fiber, related to the present invention, and the processed work and cotton work thereof contain carbon powder inside of fiber beforehand, they have superior deodorization and hygroscopicity, carbon contained will not be fallen, and they can be formed to required form so that flexibility is high.

Moreover, the processed work and the cotton work containing carbon powder on at least one of the fiber surface and inside thereof, related to the present invention have superior deodorization and hygroscopicity. In addition, since carbon powder is contained without using high polymer binder, such as acrylic resin, safety is very high.

Since the process of producing the processed work and the cotton work comprise the steps of: at least one of spraying or immersion of a diluted solution of emulsion to the processed work, said diluted solution of emulsion comprising at least carbon powder, surfactant and water; and drying said work with heating, carbon powder can be contained without using high polymer binder, such as acrylic resin. For this reason, a disagreeable smell does not occur when manufacturing, and it can manufacture safely.

Moreover, since emulsion is used, carbon powder can be contained even the inside of the processed work and the cotton work.

What is claimed is:

1. A single fiber containing carbon powder inside the fiber, wherein it is comprised by melting and spinning out of synthetic resin pellet compounding 1–50 weight % of fine carbon powder having 20 $\mu$m or less as pigment, wherein said fine carbon powder comprises at least Bintyo charcoal.

2. A single fiber wherein fine carbon powder has the size of 1.0 $\mu$m and 6–15 weight % thereof is compounded.

3. The single fiber as claimed in claim 1, wherein said fine carbone powder further comprises carbon black. further comprises carbon black.

4. The single fiber as claimed in claim 2, wherein said fine carbon powder comprises at least one of Bintyo charcoal and carbon black.

5. The single fiber as claimed in claim 1, wherein said synthetic resin pellet comprises recycled polyethylene terephthalate.

6. The single fiber as claimed in claim 2, wherein said synthetic resin pellet comprises recycled polyethylene terephthalate.

7. The single fiber as claimed in claim 3, wherein said synthetic resin pellet comprises recycled polyethylene terephthalate.

8. The single fiber as claimed in claim 4, wherein said synthetic resin pellet comprises recycled polyethylene terephthalate.

9. The processed work wherein the single fiber as claimed in claim 1 is twisted to make knitting yam or weaving yam and then it becomes knitting goods or textiles.

10. The processed work wherein the single fiber as claimed in claim 2 is twisted to make knitting yarn or weaving yarn and then it becomes knitting goods or textiles.

11. The processed work wherein the single fiber as claimed in claim 3 is twisted to make knitting yarn or weaving yarn and then it becomes knitting goods or textiles.

12. The processed work wherein the single fiber as claimed in claim 4 is twisted to make knitting yarn or weaving yarn and then it becomes knitting goods or textiles.

13. The processed work wherein the single fiber as claimed in claim 5 is twisted to make knitting yarn or weaving yarn and then it becomes knitting goods or textiles.

14. The processed work wherein the single fiber as claimed in claim 6 is twisted to make knitting yarn or weaving yarn and then it becomes knitting goods or textiles.

15. The processed work wherein the single fiber as claimed in claim 7 is twisted to make knitting yarn or weaving yarn and then it becomes knitting goods or textiles.

16. The processed work wherein the single fiber as claimed in claim 8 is twisted to make knitting yarn or weaving yarn and then it becomes knitting goods or textiles.

17. The cotton work wherein the single fiber as claimed in claim 1 is cotton-opened.

18. The cotton work wherein the single fiber as claimed in claim 2 is cotton-opened.

19. The cotton work wherein the single fiber as claimed in claim 3 is cotton-opened.

20. The cotton work wherein the single fiber as claimed in claim 4 is cotton-opened.

21. The cotton work wherein the single fiber as claimed in claim 5 is cotton-opened.

22. The cotton work wherein the single fiber as claimed in claim 6 is cotton-opened.

23. The cotton work wherein the single fiber as claimed in claim 7 is cotton-opened.

24. The cotton work wherein the single fiber as claimed in claim 8 is cotton-opened.

25. A processed work wherein carbon powder is contained on at least one of a surface and an inside of the fibers.

26. A cotton work wherein carbon powder is contained on at least one of a surface and an inside of the fibers.

27. The processed work wherein carbon powder is contained on at least one of the surface and the inside of the processed work as claimed in claim 9.

28. The processed work wherein carbon powder is contained on at least one of the surface and the inside of the processed work as claimed in claim 10.

29. The processed work wherein carbon powder is contained on at least one of the surface and the inside of the processed work as claimed in claim 11.

30. The processed work wherein carbon powder is contained on at least one of the surface and the inside of the processed work as claimed in claim 12.

31. The processed work wherein carbon powder is contained on at least one of the surface and the inside of the processed work as claimed in claim 13.

32. The processed work wherein carbon powder is contained on at least one of the surface and the inside of the processed work as claimed in claim 14.

33. The processed work wherein carbon powder is contained on at least one of the surface and the inside of the processed work as claimed in claim 15.

34. The processed work wherein carbon powder is contained on at least one of the surface and the inside of the processed work as claimed in claim 16.

35. The cotton work wherein carbon powder is contained on at least one of the surface and the inside of the cotton work as claimed in claim 17.

36. The cotton work wherein carbon powder is contained on at least one of the surface and the inside of the cotton work as claimed in claim 18.

37. The cotton work wherein carbon powder is contained on at least one of the surface and the inside of the cotton work as claimed in claim 19.

38. The cotton work wherein carbon powder is contained on at least one of the surface and the inside of the cotton work as claimed in claim 20.

39. The cotton work wherein carbon powder is contained on at least one of the surface and the inside of the cotton work as claimed in claim 21.

40. The cotton work wherein carbon powder is contained on at least one of the surface and the inside of the cotton work as claimed in claim 22.

41. The cotton work wherein carbon powder is contained on at least one of the surface and the inside of the cotton work as claimed in claim 23.

42. The cotton work wherein carbon powder is contained on at least one of the surface and the inside of the cotton work as claimed in claim 24.

* * * * *